US005696341A

United States Patent [19]

McCane

[11] Patent Number: 5,696,341

[45] Date of Patent: Dec. 9, 1997

[54] GUITAR STRING TUNING SYSTEM

[76] Inventor: William Todd McCane, 142 Hideout Hill, Marthasville, Mo. 63357

[21] Appl. No.: 526,742

[22] Filed: Sep. 12, 1995

[51] Int. Cl.[6] ..... G10D 3/14

[52] U.S. Cl. ..... 84/453; 84/304; 84/458

[58] Field of Search ..... 84/453, 458, 304, 84/305, 306, 297 R, 290

[56] References Cited

U.S. PATENT DOCUMENTS

| | | | |
|---|---|---|---|
| 4,367,671 | 1/1983 | Chance et al. | 84/306 |
| 4,476,770 | 10/1984 | McGowan | 84/458 |
| 5,272,953 | 12/1993 | Koch | 84/458 |
| 5,277,095 | 1/1994 | Steinberger | 84/304 |
| 5,388,491 | 2/1995 | John | 84/304 |

OTHER PUBLICATIONS

Advertising Brochure for Precision Tuners by LSR, 2406 Button Court, Santa Hosa, California 95403.

*Primary Examiner*—Cassandra C. Spyrou

*Attorney, Agent, or Firm*—Herzog, Crebs & McGhee, LLP

[57] ABSTRACT

A tuning knob and tuning knob system for a stringed instrument such as a guitar replaces the existing tuning knob. The present tuning knob is a cylindrical knob with exterior knurls and a central bore therethrough. At one end, the bore is adapted to be received over the tuning stem while the other end of the bore is configured to receive a crank. The crank provides additional leverage for instrument tuning.

6 Claims, 2 Drawing Sheets

GUITAR STRING TUNING SYSTEM

FIELD OF THE INVENTION

The present invention relates to string instruments and, more particularly, to devices for tuning guitar strings.

BACKGROUND OF THE INVENTION

In guitars and other stringed musical instruments, such as sitars, banjos and the like, strings of various diameters are stretched across a bridge over a resonant box in order to produce sound. The strings terminate at one end to a hold down device on the resonant box, while the other end of the strings terminate on revolvable pegs disposed on a tuning head that is attached to a sleeve of the instrument. From time-to-time, the musician must replace a broken string or retune the particular string to the correct frequency. Each string is separately tuned to the desired frequency by adjusting its tension through rotation of a winding stem operatively coupled to the revolvable peg. Generally, the strings are tuned through loosening and tightening thereof. A stem knob coupled to the winding stem is gripped between the fore finger and thumb and hand cranking.

However, in some instances, it is not possible to accurately tune or tighten the strings by the fingers alone. It my not be possible to even rotate the knob.

Various prior art mechanisms have been devised to facilitate the tuning of such stringed instruments as guitars. These devices have ranged from ratchet and gear mechanisms to add on knobs.

However, these prior devices still require a sufficient amount of hand applied torque to adequately adjust the strings or are cumbersome to have and/or operate.

It is thus an object of the present invention to provide a device to facilitate the tuning of stringed instruments such as guitars.

It is a further object of the present invention to provide an after-market guitar string tuning assembly to replace the factory knobs to facilitate tuning.

SUMMARY OF THE INVENTION

The present invention is a guitar tuning knob adapted to receive a detachable crank for tuning the strings of the guitar. A manual or automatic screw driver may alternatively be used to turn the tuning knob.

The knob is further adapted to be mounted on an existing guitar string tuning knob stem. The knob is cylindrical shaped and includes knurls on the outside surface for gripping with the fingers. The knob has a central axial bore extending therethrough. The central axial bore defines a first diameter with a second diameter portion on one end that is sized to be received on the guitar string mounting stem. The central axial bore that further has a third diameter portion adapted to receive the end of the crank. The crank is an angled hexagonal-shaped metal member.

In accordance with another aspect of the present invention, the tuning knob and crank are presented as an after-market kit for attachment to the guitar. The kit includes the hardware necessary to make the attachment.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiment thereof which is illustrated in the appended drawings.

It is noted, however, that the appended drawings illustrate only a typical embodiment of this invention and are therefore not to be considered limiting of its scope, for the invention may admit to other equally effective embodiments. Reference the appended drawings, wherein.

DESCRIPTION OF THE PREFERRED EMBODIMENT

Figure 1:
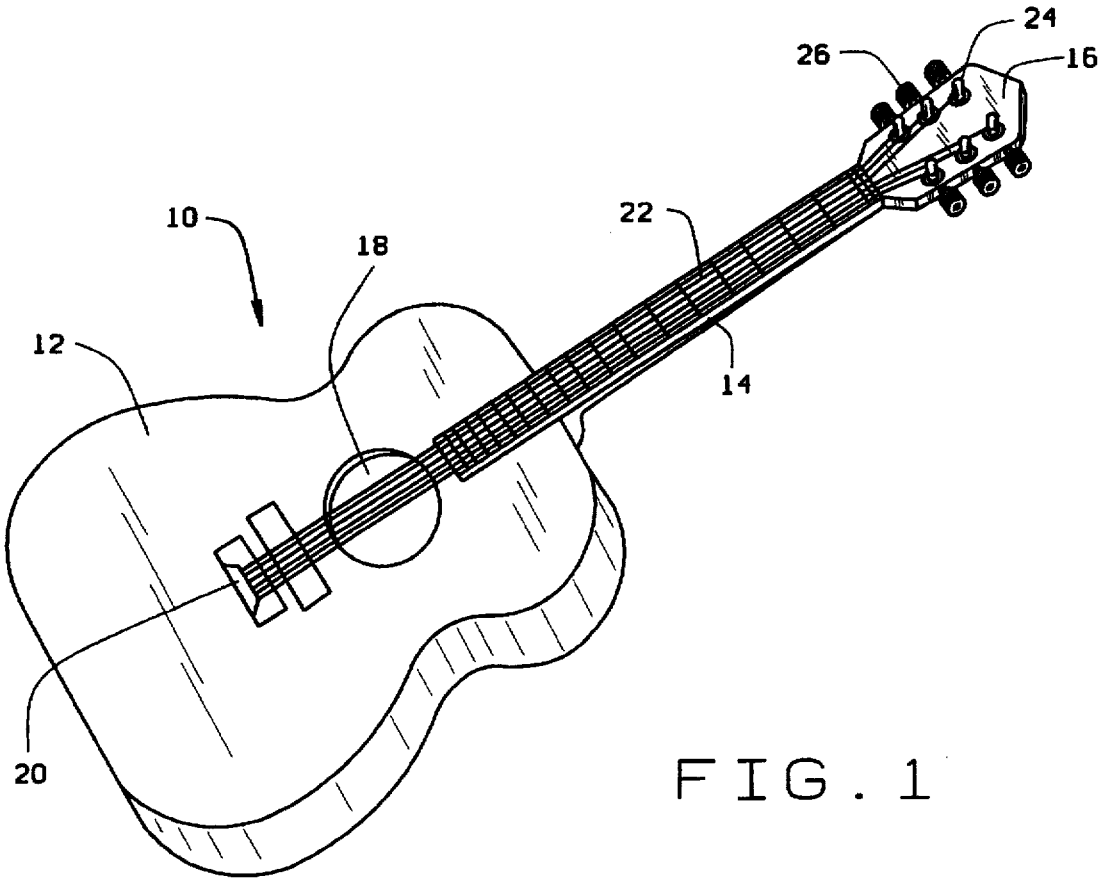
FIG. 1 is perspective view of a typical guitar having tuning knobs according to the present invention.

Referring to FIG. 1, there is shown a typical six string guitar generally designated 10. The guitar 10 includes a body 12 having a stem or handle 14 attached to a top portion of the body 12 with a tuning head 16 attached to the end of the stem 14 opposite the body 12. As is typical, the body 12 includes a resonant opening 18 and a string mounting platform 20 located near the bottom of the body 12 adjacent the resonant opening 18. The guitar 10 further includes a plurality of strings, generally designated 22 that are attached at one end to the string mounting assembly 20 and terminate at revolvable tuning pegs 24 disposed in the head 16. Each string 22 is connected to a separate tuning peg 24 and is wrapped therearound in known manner in the art.

Figure 2:
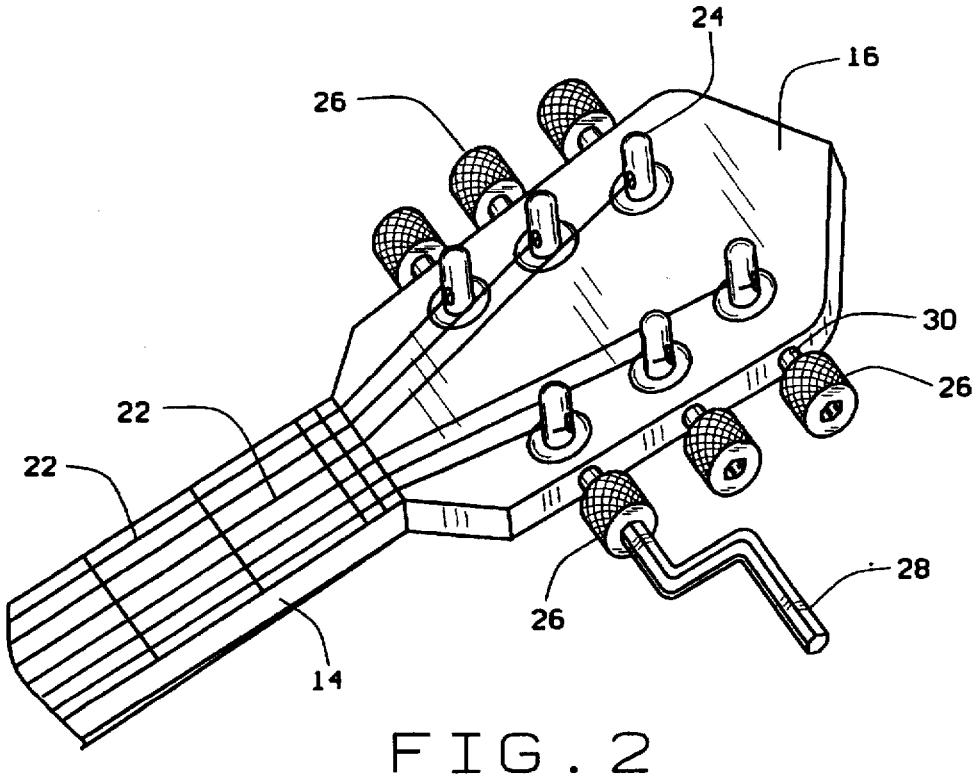
FIG. 2 as an enlarged perspective view of the guitar head having the present tuning knobs attached to the tuning stems with a tuning crank in place.

Referring now to FIG. 2, the guitar head 16 is shown in enlarged detail. Each string 22 is shown attached to one of the revolvable or rotatable tuning peg 24, thus there are six (6) such tuning pegs. The tuning pegs 24 are each operatively connected via gearing or the like (not shown) on the underside of the head 16 to a rotatable transverse mounting stem 30. It should be understood that the tuning pegs 24 are coupled to the mounting stems 30 in a manner known in the art such that rotation of the tuning stem 30 causes rotation of the respectively coupled tuning peg 24. The direction of rotation of the tuning stem 30 corresponds to a direction of rotation of the tuning peg 24 to either tighten or loosen the associated string 22 along the neck 14 and body 12 of the guitar 10.

Figure 4:
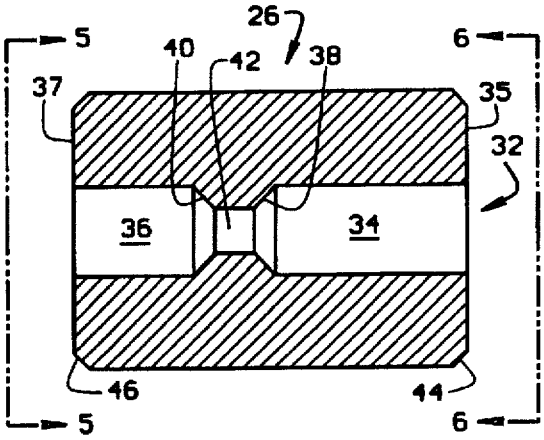
FIG. 4 is an enlarged cross-section view of the present tuning knob.

In accordance with the present invention a tuning knob 26 is shown attached to each tuning stem 30. For reference, a tuning crank 28 is shown disposed in one end of the tuning knob 26 in accordance with the present invention. The tuning knob 26 is cylindrical-shaped and includes a central axial bore 32 extending from one end of the knob to the other. Referring specifically to FIG. 4, the bore 32 defines a first diameter portion 34 extending from the right end 35 of the knob 26 an axial distance into the knob 26, and a second diameter portion 36 extending from the left end 37 of the knob 26 an axial distance into the knob. The first and second diameter portions 34, 36 extend into the knob 26 a given distance such that a third diameter portion 42 is defined. The first and second diameter portions 34 and 36 are thus in communication with each other via the third diameter portion 42, via annularly tapered ends 38 and 40. Thus, the bores 34, 36, and 42 constitute the central bore 32. The knob 26 further includes a bevel or chamfer 44 on the right peripheral end and a bevel or chamfer 46 on the left peripheral end thereof as viewed in FIG. 4.

Figure 3:
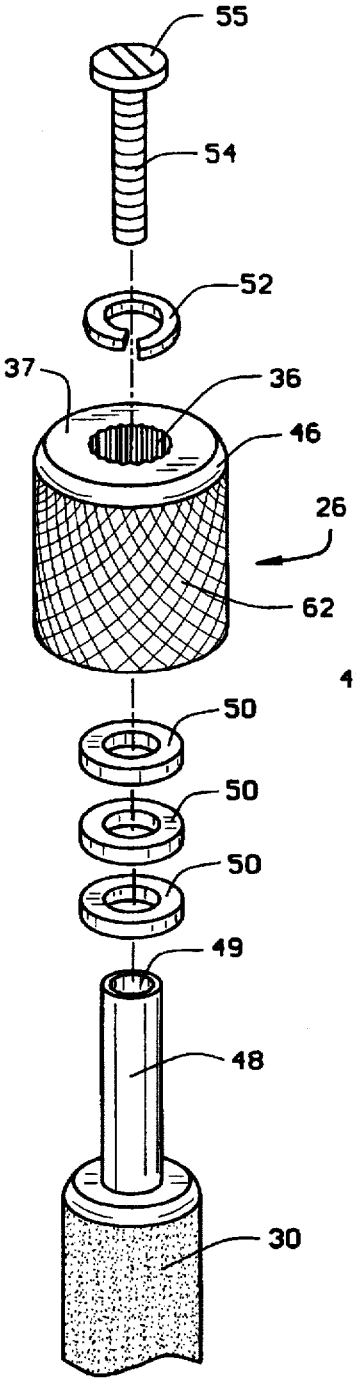
FIG. 3 is an exploded view of the assembly of the present tuning knob onto the mounting peg.
Figure 6:
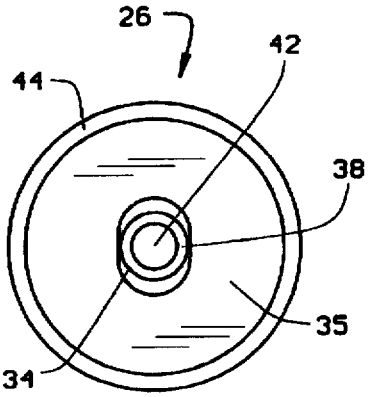
FIG. 6 is an enlarged right end view of the present tuning knob taken along line 6—6 of FIG. 4.

As best seen in FIG. 6, the first diameter portion 34 is shaped to receive the oval stem portion 48 of to the central stem 30. Referring now to FIG. 3, the manner in which the knob 26 is attached to or assembled on the stem 30 is shown in an exploded view. Several washers 50, shown here as three washers, are sized to be received over the stem 48. More or less washers 50 may be used depending on the length of the stem portion 48. The knob 26 is placed onto the stem portion 48 with the bore 34 towards the stem 30. The annular taper 38 seats the stem portion 48 within the knob 26. A spring washer 52 is inserted in the second diameter portion 36 with a screw or bolt 54 placed therein. The screw 54 extends through the bore 32 to engage the threaded bore 49 in the stem portion 48. Upon tightening, the bolt head 55 engages and rests against the annular taper 40, thus tightening and attaching the knob 26 onto the stem 30.

Figure 5:
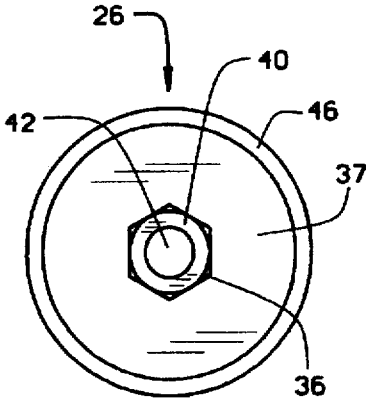
FIG. 5 is an enlarged left end view of the tuning knob as taken along line 5—5 of FIG. 4.
Figure 7:
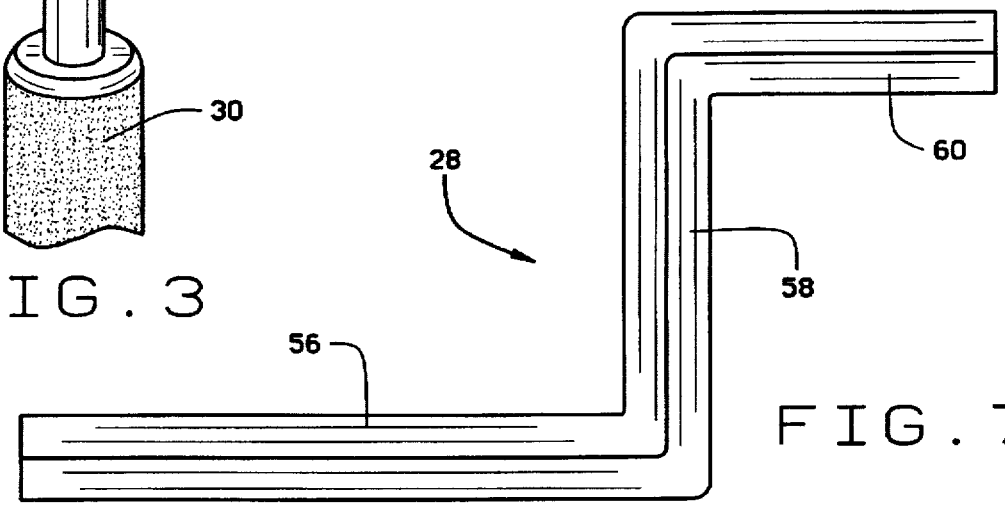
FIG. 7 is an enlarged side view of the crank according to the present invention.

In accordance with the present invention and referring to FIG. 7, a crank 28 is provided. The crank 28 includes a first length 56 having a hexagonal cross-section with a transverse second member 58 attached at one end that also has a hexagonal cross-section, and a third portion 60 transverse to the second portion 58 and connected to the end opposite the connection to the first portion 56. The third portion 60 likewise has a hexagonal cross-section. It can be seen from FIG. 5 that the second diameter portion 36 has a hexagonal cross-section 64 for receipt of the crank 28. While the knob 26 has knurls 62 on the outside surface thereof for frictional gripping of the knob to turn between the fingers, the knob includes the keyed bore for receiving the crank as best shown in FIG. 2. It should be apparent that other configurations of crank and associated bore may be utilized.

In operation, and referring to FIG. 2, the strings 22 of the guitar are each wound on a separate tuning peg 24. Thus, as the knob 26 is rotated, the peg 24 likewise rotates to loosen or tighten the strings. The crank 28 is insertable into the hexagonal bore 36 to provide leverage and ease of string tuning. Alternatively, the crank may be attached to a manual or automatic screwdriver for additional leverage.

While the foregoing is directed to the preferred embodiment of the present invention, other and further embodiments of the invention may be devised without departing from the basic scope thereof, and the scope thereof is determined by the claims which follow.

What is claimed is:

1. A tuning knob for a guitar, the tuning knob comprising:

a cylindrical body having knurls on an outside surface and defining a first end and a second end;

an axial bore extending through said body from said first end to said second end, said axial bore having a first portion of a first axial length extending from said first end towards said second end, said first portion sized and configured to be received on a tuning stem of the guitar, the tuning stem having a threaded bore, said axial bore of the body further having a second portion of a second axial length extending from said second end towards said first end, said second portion having a predetermined cross-sectional shape to receive an end of a tuning crank of the same predetermined cross-sectional shape, said axial bore further including a third portion in communication with and between said first and second portions, said third portion having a diameter less than said first and second portions; and a screw with a threaded stem and a head, said threaded stem placed through said axial bore, threadedly coupled to the threaded bore of the tuning stem, said head of said screw retained by said second portion of said axial bore, thus securing said body to the tuning stem of the guitar.

2. The tuning knob of claim 1, wherein said first portion includes a first annular taper at an end of said first axial length opposite said first end, and said second portion includes a second annular taper at an end of said second axial length opposite said second end.

3. An after-market guitar tuning knob as a replacement for an existing guitar tuning knob, the after-market tuning knob comprising:

a cylindrical body having knurls on an outer annular surface thereof, said body defining a first end and a second end;

a first annular bevel on a periphery of said first end;

a second annular bevel on a periphery of said second end;

a central axial bore in said body extending from said first end to said second end, said bore including a first portion of a first cross-sectional shape extending an axial distance from said first end, a second portion of a second cross-sectional shape, extending an axial distance from said second end, and a third portion in communication with and between said first and second portions;

a first annular taper at an end of said first portion adjacent said third portion; and a second annular taper at an end of said second portion adjacent said third portion.

4. The after-market guitar string tuning knob of claim 3, wherein said first cross-sectional shape is an oval adapted to be received on an end of a guitar tuning stem, and said second cross-sectional shape is a hexagonal.

5. The after-market tuning knob of claim 4, further comprising a crank having a hexagonal cross-section adapted to be received in said second portion to rotate the tuning knob.

6. An after-market guitar string tuning kit comprising:

a tuning knob;

a screw; and a tuning crank;

said tuning knob having a cylindrical body having knurls on an outer annular surface thereof, said body defining a first end and a second end, a first annular bevel on a periphery of said first end, a second annular bevel on a periphery of said second end, a central axial bore in said body extending from said first end to said second end, said bore including a first segment having an oval cross-section extending an axial distance from said first end, a second segment having a hexagonal cross-sectional shape extending an axial distance from said second end, and a third segment in communication with and between said first and second segments, a first annular taper at an end of said first segment adjacent said third segment and a second annular taper at an end of said second segment adjacent said third segment;

said crank having a hexagonal cross-section adapted to be received in said second segment, said crank having a first straight section, a second straight section transverse to and extending from one end of said first straight section, and a third straight section transverse to and extending from an end of said second straight section opposite to said first straight section;

said screw adapted to be received in said bore and securing said knob to the guitar tuning stem, wherein a head of said screw abuts and is retained by said second annular taper.

* * * * *